US005820904A

United States Patent [19]

Mello et al.

[11] Patent Number: 5,820,904

[45] **Date of Patent: *Oct. 13, 1998**

[54] MEAT PRODUCT PACKAGE AND METHOD OF FORMING SAME

[75] Inventors: Frank C. Mello, Columbus, Miss.; Roger S. Williams, New Richmond, Ohio; Jeffrey A. Williams, Calhoun, Ga.

[73] Assignee: Sara Lee Corporation, Winston-Salem, N.C.

[ * ] Notice: The term of this patent shall not extend beyond the expiration date of Pat. No. 5,770,249.

[21] Appl. No.: 759,710

[22] Filed: Dec. 6, 1996

Related U.S. Application Data

[63] Continuation-in-part of Ser. No. 489,390, Jun. 12, 1995, abandoned.

[51] Int. Cl.[6] ..... B65D 85/08; B65B 25/06

[52] U.S. Cl. ..... 426/119; 426/129; 426/392; 53/428; 53/429; 206/471; 206/563; 206/564

[58] Field of Search ..... 426/129, 119, 426/413, 414, 392; 206/564, 563, 443, 471, 526, 363, 446; 53/428, 429; D9/345

[56] References Cited

U.S. PATENT DOCUMENTS

| | | | |
|---|---|---|---|
| 2,379,934 | 7/1945 | Seiferth | 206/443 |
| 2,903,139 | 9/1959 | Penman | D9/345 |
| 3,216,832 | 11/1965 | King | 426/414 |
| 3,464,618 | 9/1969 | Martelli et al. | D9/345 |
| 3,676,159 | 7/1972 | Fallowfield | 426/129 |
| 3,792,181 | 2/1974 | Mahaffy et al. | 426/129 |
| 3,903,309 | 9/1975 | Mahaffy et al. | 426/129 |
| 4,158,408 | 6/1979 | Thiessen | 426/119 |
| 4,232,787 | 11/1980 | Holiday | 206/443 |
| 4,522,301 | 6/1985 | Ajmera | 426/119 |
| 5,005,703 | 4/1991 | Brodker | 206/563 |
| 5,199,567 | 4/1993 | Discko | 206/564 |
| 5,353,929 | 10/1994 | Foster | 206/564 |

FOREIGN PATENT DOCUMENTS

| | | | |
|---|---|---|---|
| 482589 | 1/1970 | Switzerland | 426/119 |
| 2134490 | 8/1984 | United Kingdom | 206/363 |

*Primary Examiner*—Steven Weinstein
*Attorney, Agent, or Firm*—Charles Y. Lackey; Kilpatrick Stockton LLP

[57] ABSTRACT

A meat product package for storing and displaying a plurality of tubular meat products preferably in an arcuate configuration, the package having a meat product forming section with plural arcuate recesses utilizing overformed recess edges to hold the tubular meat products in a curved position under tension within the recesses for storage and display. An alternative embodiment includes a method of arcuately shaping straight sticks of meat products cooked or smoked in a casing and placing them in a formed film pocket made on a form-fill-seal rollstock packaging machine.

9 Claims, 4 Drawing Sheets

MEAT PRODUCT PACKAGE AND METHOD OF FORMING SAME

This is a continuation-in-part application of my earlier application Ser. No. 08/489,390 for MEAT PRODUCT PACKAGE filed Jun. 12, 1995, now abandoned.

BACKGROUND OF THE INVENTION

1. Field of the Invention

The present invention relates generally to meat product packages and more particularly to a meat product package and method of forming same fashioned to retain a plurality of tubular meat products in an arcuate and natural configuration.

2. Description of the Prior Art

Tubular meat product casings made from animal intestines normally contain the natural curve of the casing after the packaging process. This "old world" configuration was accepted and well-known and still suggests processing in that early natural way practiced many years ago in the meat industry, particularly in Europe. There is an inherent marketplace attraction to this package appearance, and such appearance is notably absent from the majority of packages used in the current market.

Conventional tubular meat product packages deal with various ways of efficiently and securely packaging substantially straight or linear tubular meat products. More attention is given to package sealing and product preservation once the package has been opened, and product accessibility as it is being used over a period of time. Virtually no tubular product package captures the "old world" or traditional natural curve arising from the use of cattle, hog or sheep gut intestine lining that generally conforms to the curve set when it resided in the animal while it was alive. There is a consumer attraction to that natural curve, and the present invention is developed to meet that consumer attraction.

OBJECTIVES AND SUMMARY OF THE INVENTION

The primary objective of the present invention is to develop a tubular meat product package that will retain and display tubular meat products such as sausages, smoked kielbasa, bratwurst and the like in a manner that will display to the customer a natural curve earlier experienced from the use of cattle, hog or sheep gut intestines.

Another objective of the present invention is to develop a tubular meat product package utilizing over formed edges to maintain the tubular meat products in a preselected arcuate and slightly tensioned condition.

Still another objective of the present invention is to develop an alternative meat product package that will retain and display tubular meat products of the type previously described in a natural old world curve utilizing a formed film pocket adapted to receive arcuately shaped sticks of meat product for closure on a form-filled-seal rollstock packaging machine.

Yet another objective of the present invention is to develop meat product packages of the types described and method of forming same that can store and display from one to twelve tubular meat products in various lengths and diameters and through a range of angular arches.

The present invention is a meat product package utilizing a forming section for receiving a plurality of tubular meat products which has one or more arcuate recesses to receive such meat products. Each recess has a bottom portion, side portions, and end portions, some of which have overformed edges to hold the tubular meat products within the recess under tension and in the desired arcuate condition for storage and display. An alternative embodiment permits the arcuate shaping of straight sticks of meat products within a formed film pocket with the package being completed on a standard form-filled-seal rollstock packaging machine.

Meat products packaged in the meat product package comprising the present invention will generally retain their arcuate shape imparted by the structure after they are removed from the package up until the time they are cooked.

Thus, there has been outlined, rather broadly and in summary form, the more important features of the invention in order that the detailed description that follows may be better understood and in order that the present contribution to the art may be better appreciated. There are obviously additional features of the invention that will be described hereinafter and which will form the subject matter of the claims appended hereto. In this respect, before explaining several embodiments of the invention in detail, it is to be understood that the invention is not limited in its application to the details of construction and to the arrangement of the components set forth in the following description or illustrated in the drawings. The invention is capable of other embodiments and of being practiced and carried out in various ways.

It is also to be understood that the phraseology and terminology herein are for the purpose of description and should not be regarded as limiting in any respect. Those skilled in the art will appreciate the concept upon which this disclosure is based and that it may readily be utilized as a basis for designing other structures, methods and systems for carrying out the several purposes of the present invention. It is also to be understood that the abstract is neither intended to define the invention of the application, which is measured by its claims, nor to limit its scope in any way.

This summary and these objectives of the invention, along with the various features of novelty which characterize the invention, are pointed out with particularity in the claims annexed to and forming a part of this disclosure. For a better understanding of the invention, its operating advantages and the specific objects attained by its use, reference should be made to the accompanying drawings and descriptive matter in which like characters of reference designate like parts throughout the several views.

DESCRIPTION OF THE PREFERRED EMBODIMENT

Figure 1:
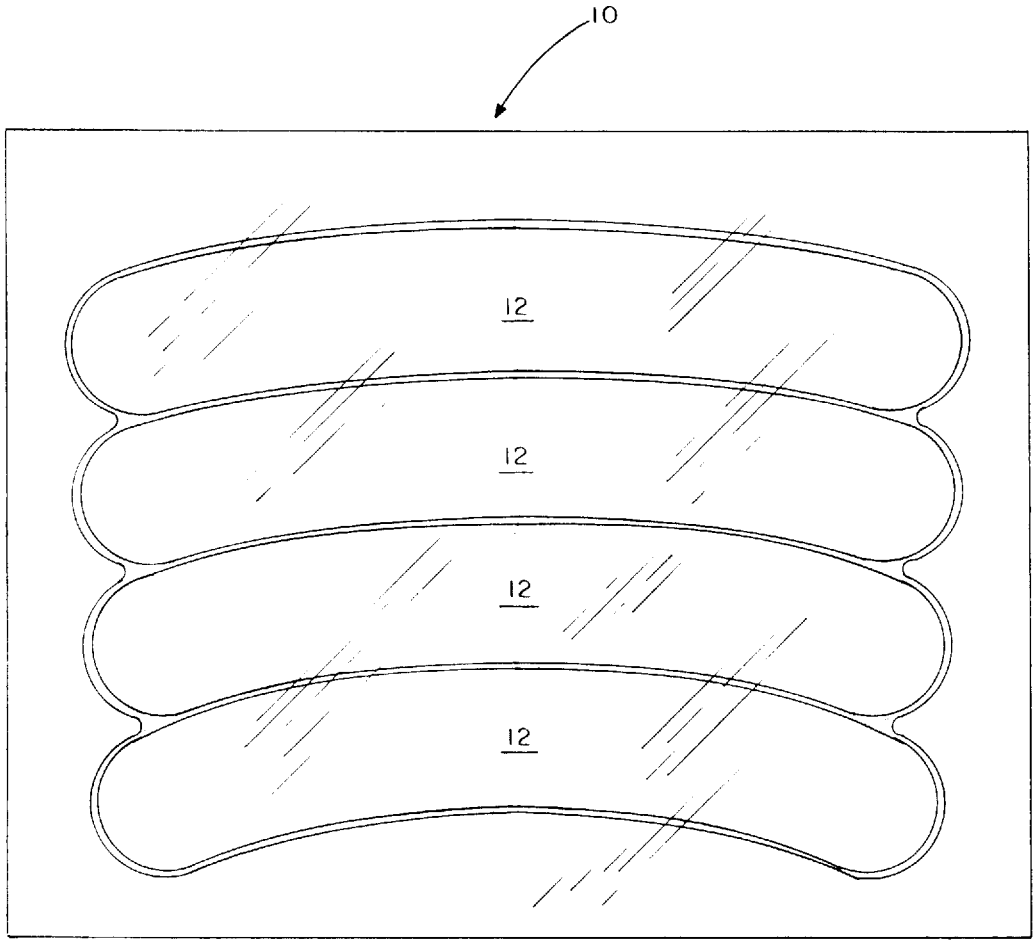
FIG. 1 is a plan view of the food product package comprising the present invention illustrating the utilization of four recesses to store and display four tubular meat products.

Referring now to the drawings and particularly to FIG. 1, a meat product package shown generally as 10 is shown in this embodiment to accommodate four tubular meat products in an "old world" natural arcuate condition. The package is fabricated to retain the tubular meat products 12 in a curved configuration thus simulating "old world" sausage or similar products. A plurality of recesses 14 which may range in number from 1 to 12 are formed in a forming section or tray shown generally as 16 in a manner to retain the meat products in a curved position under tension so that they will not escape.

Maintaining the tubular meat products in the curved and natural condition is achieved by overforming the edges 18 of recesses 14 at least along the side portions 20 and even when desired along the end portions 22.

Figure 2:
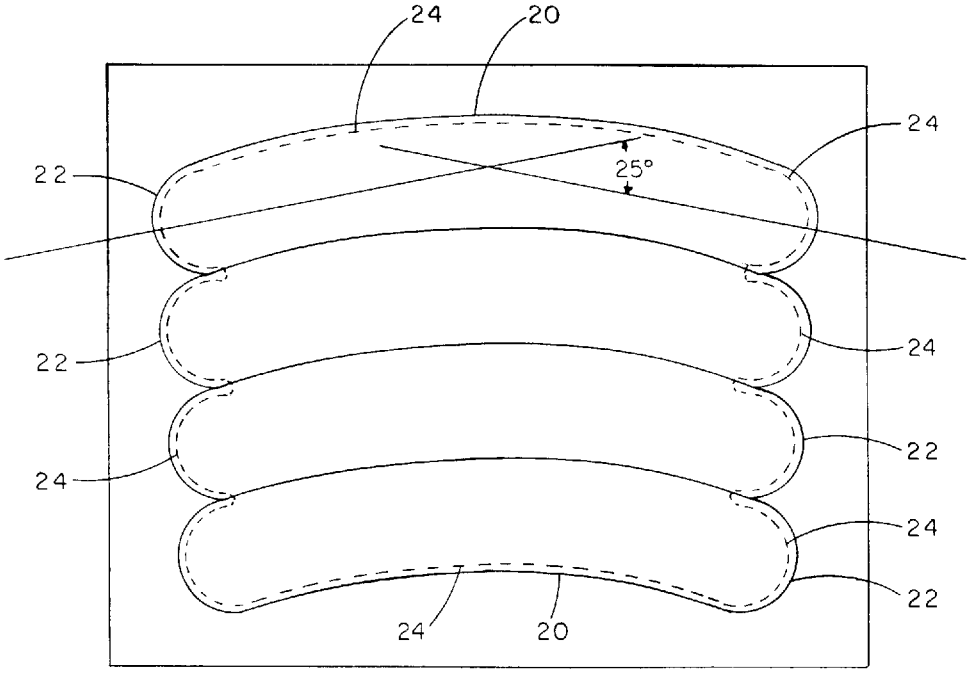
FIG. 2 is a plan view of the meat product package shown in FIG. 1 wherein the tubular meat product location is shown in hidden lines to emphasize the overformed edges of each recess.
Figure 3:
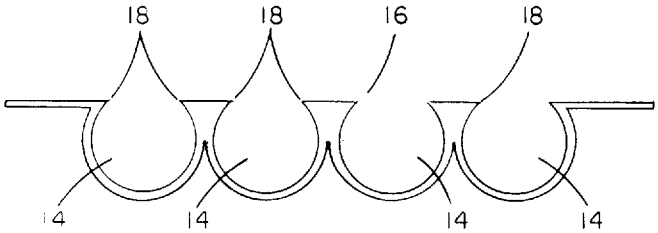
FIG. 3 is an end elevational, partial view of the meat product package shown in FIG. 1 illustrating the overformed side edges utilized to hold the tubular meat products within the recesses under tension for storage and display.

Dotted line 24 in FIG. 2 represents the top or overformed edge of the package while the tubular meat products 12 extend to the sides 20 and ends 22, thus resulting in a retention of the meat products within the recesses because of the overformed edges.

The product may be placed into the recesses either manually or by appropriate mechanical means. Obviously the arch of the desired curve can be within a rather wide range (25° in FIG. 2), the most practically being between 0° and 180° . The important feature in developing an acceptable angular arch is to make certain that the meat product will not break when bent to the required angular arch.

Figure 7:
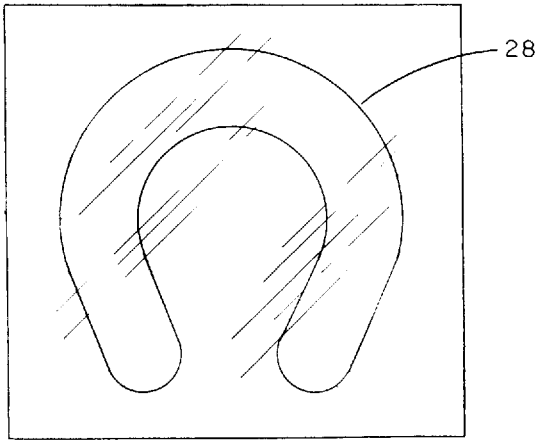
FIG. 7 is a plan view of the product shown in FIGS. 4 and 5 which has been completely formed within a formed film pocket.
Figure 8:
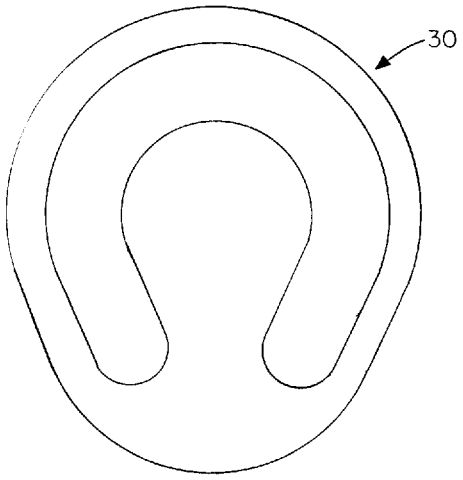
FIG. 8 is a plan view of a final package of the alternative embodiment which has been vacuum sealed and trimmed.

In an alternative embodiment of the present inventive concept, a straight stick meat product 26 is shaped from a linear condition to the desired angular arc either manually or by mechanical means. When the desired arch is achieved, it is positioned in a formed film pocket 28 having sides 30 and ends 32, both having overformed edges 34. The pocket 28 and product are thereafter positioned on a standard form-filled-seal rollstock packaging machine for sealing. The formed package is thereafter cut to the desired package configuration such as the arcuate form 30 shown in FIG. 7.

Figure 4:
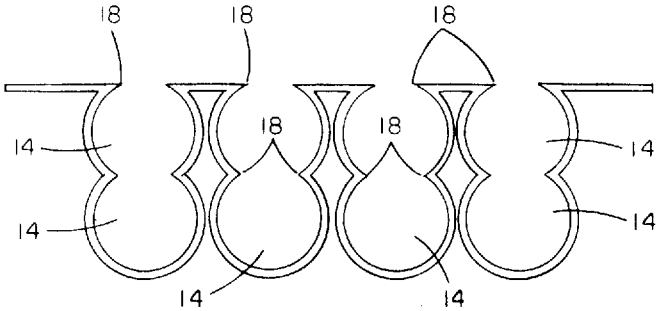
FIG. 4 is an end elevational view like that shown in FIG. 3 of a package for holding two layers of meat products.
Figure 5:
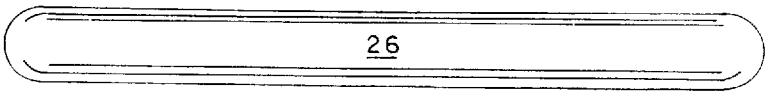
FIG. 5 is a plan view of a straight stick of meat product such as sausage which has been cooked or smoked in a tubularly formed plastic fill.
Figure 6:
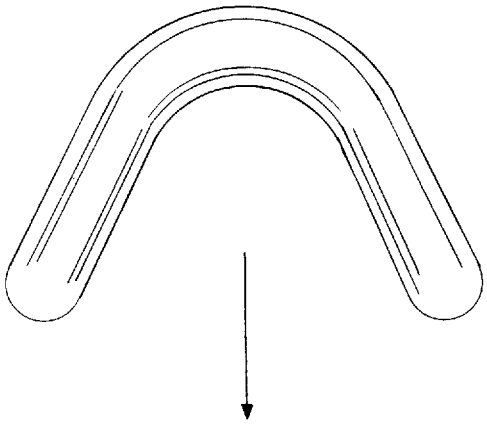
FIG. 6 is a plan view of the meat product shown in FIG. 4 which has been partially bent to commence the formation of an alternative package embodiment.

The packages comprising the present invention are suitable for use with a variety of meat products including sausage, kielbasa, frankfurters and other such items which may be processed with "skinless" or other artificial casings. These types of casings (cellulose, collagen, etc.) generally do not result in a product having a natural curvature. Moreover, the forming section may contain stacked recesses up to four layers of tubular meat products in addition to a variety of planar meat products, within a range of from 1 to 12. FIG. 4 illustrates an example of this stacked concept.

The packages comprising the present invention may vary in size to store and display tubular meat products from ¼ inch to 1¼ inches in diameter, and from 3 to 12 inches in length.

It is to be realized that the optimum dimensional relationship for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed herein.

The foregoing is considered illustrative only of the principles of the invention. Since numerous modifications and changes will readily occur to those skilled in the art, it is intended not to limit the invention to the exact construction and operation shown and described. All suitable modifications and equivalents that fall within the scope of the appended claims are deemed within the present inventive concept.

What is claimed is:

1. A meat product package for displaying in an arcuate arrangement at least one elongated, free ended, sausage-shaped meat product which has been processed prior to packaging such that the meat product normally maintains a substantially straight shape, said package comprising: a tray and at least one of said elongated, free ended, sausage-shaped, processed meat products, each meat product having a longitudinal axis, the tray having at least one elongated recess with each recess containing one of said products, each recess having a longitudinal arcuate configuration and each recess being suitably sized to receive the normally substantially straight meat product after it has been bent and to hold the normally substantially straight meat product in the arcuate configuration of the recess under tension, each recess having a bottom portion, side portions and end portions, the bottom and side portions extending substantially parallel to the product longitudinal axes, and the side and end portions having overformed edges, said overformed edges extending along the arcuate configuration of the recesses to maintain the sausage-shaped meat product in the arcuate configuration under tension within the recess for storage and display.

2. The package as claimed in claim 1 wherein each recess is sufficient in size to retain the sausage-shaped meat product up to 12 inches in length.

3. The package as claimed in claim 1 wherein each recess is sufficient in size to retain the sausage-shaped product up to 1½ inches in diameter.

4. The package as claimed in claim 1 wherein each recess has a substantially circular cross-section.

5. The package as claimed in claim 1 wherein each recess is arched in a range up to 180 degrees.

6. The package as claimed in claim 1 wherein the number of recesses in the tray are within a range of from 2 to 12.

7. A method for packaging meat in a meat product package for displaying in an arcuate arrangement at least one elongated, free ended, sausage-shaped meat product which has been processed prior to packaging such that the meat product normally maintains a substantially straight shape, said method comprising the steps of: providing a tray and at least one of said elongated, free ended, sausage-shaped, processed meat products, the at least one meat product having a longitudinal axis, the tray having at least one elongated recess, the at least one recess having a longitudinal arcuate configuration and being suitably sized to receive the normally substantially straight meat product therein after it has been bent, and to hold the normally substantially straight meat product in the arcuate configuration of the recess under tension, the recess having a bottom portion, side portions and end portions, the bottom and side portions extending substantially parallel to the product longitudinal axis, and the side and end portions having overformed edges, said overformed edges extending beyond the arcuate configuration of the recess to maintain the sausage-shaped meat product in the arcuate configuration under tension within the recess for storage and display; arranging the at least one substantially straight processed meat product in an arcuate configuration under tension to conform to the elongated arcuate recess and positioning the at least one tensioned and arcuately configured meat product within the at least one respective recess such that the overformed edges maintain the meat product in the arcuate configuration under tension.

8. The method as claimed in claim 7 wherein at least the side portions have overformed edges to hold the tubular meat product within the recess for storage and display.

9. The method as claimed in claim 7 wherein each of the one or more recesses is sufficient in size to retain a tubular meat product up to 1 and ½ inches in diameter.

* * * * *